US009084455B2

(12) United States Patent
Millan

(10) Patent No.: US 9,084,455 B2
(45) Date of Patent: Jul. 21, 2015

(54) SYSTEM, COMPONENTS AND METHOD OF A FUNCTIONAL MULTI TOOL BRACELET SYSTEM

(71) Applicant: Luis A Millan, Tucson, AZ (US)

(72) Inventor: Luis A Millan, Tucson, AZ (US)

( * ) Notice: Subject to any disclaimer, the term of this patent is extended or adjusted under 35 U.S.C. 154(b) by 0 days.

(21) Appl. No.: 14/058,258

(22) Filed: Oct. 20, 2013

(65) Prior Publication Data

US 2014/0109615 A1 Apr. 24, 2014

Related U.S. Application Data

(60) Provisional application No. 61/795,532, filed on Oct. 19, 2012.

(51) Int. Cl.

| | |
|---|---|
| ***A44C 5/00*** | (2006.01) |
| ***B26B 9/00*** | (2006.01) |
| ***B26B 11/00*** | (2006.01) |
| ***B26B 29/02*** | (2006.01) |
| *A45F 5/00* | (2006.01) |

(52) U.S. Cl.

CPC ..... *A44C 5/0007* (2013.01); *B26B 9/00* (2013.01); *B26B 11/00* (2013.01); *B26B 29/025* (2013.01); *A45F 2005/008* (2013.01); *A45F 2200/0575* (2013.01)

(58) Field of Classification Search

CPC ..... A44C 5/00; A44C 5/0007

USPC ..... 63/1.11, 1.12, 1.13; 24/614, 615; 7/158, 7/170; 30/143, 151, 297, 298

See application file for complete search history.

(56) References Cited

U.S. PATENT DOCUMENTS

| | | | | |
|---|---|---|---|---|
| 902,274 | A * | 10/1908 | Brusaud | 63/1.12 |
| 2,266,942 | A * | 12/1941 | Wallace | 63/1.12 |
| 3,706,117 | A * | 12/1972 | Axisa | 24/574.1 |
| 4,384,390 | A * | 5/1983 | Hayakawa | 224/163 |
| 7,340,809 | B2 * | 3/2008 | Tracy et al. | 24/615 |
| D691,910 | S * | 10/2013 | Kelleghan | D11/3 |
| 8,648,735 | B2 * | 2/2014 | Haynes et al. | 340/944 |
| D701,792 | S * | 4/2014 | Kelleghan | D11/216 |
| 2011/0252649 | A1 * | 10/2011 | Lovitz | 30/162 |
| 2013/0031935 | A1 * | 2/2013 | Kelleghan | 63/1.12 |
| 2013/0189631 | A1 * | 7/2013 | Mojica | 431/274 |
| 2013/0213089 | A1 * | 8/2013 | Gagne | 63/1.12 |
| 2013/0224667 | A1 * | 8/2013 | Roybal | 431/6 |

FOREIGN PATENT DOCUMENTS

JP 2007014739 A * 1/2007

* cited by examiner

*Primary Examiner* — Emily Morgan

(57) ABSTRACT

A new and useful system, method and system components are provided, for helping a person to survive in certain situations at different scenarios when find him/herself trapped on it, while performing outdoor activities, in a manner that is efficient and effective, and in a manner that is designed in a compact and a low profile design, in a manner that is lightweight, comfortable and easy to wear it, in a manner that is handy and helpful. It has been designed to help a person to improve his/her skills and/or increase his/her opportunity of survive while trapped in a difficult situation.

10 Claims, 13 Drawing Sheets

Isometric View

SYSTEM, COMPONENTS AND METHOD OF A FUNCTIONAL MULTI TOOL BRACELET SYSTEM

RELATED APPLICATION

Claim of Priority

This application is related to and claims the priority of provisional Application No. 61/795,532, filed Oct. 19, 2012, and entitled BODISS (Best Out Door Individual Survival System), which provisional application is incorporated by reference herein.

INTRODUCTION AND SUMMARY OF THE PRESENT INVENTION

The present invention relates to a new and useful system, method and components of a portable device (preferably a multi tool bracelet system) for helping a person to survive in certain situations at different scenarios when the person find him/herself trapped in while performing outdoor activities, in a manner that is efficient and effective, and in a manner that is designed in a compact and a low profile design, in a manner that is lightweight, comfortable and easy to wear it, in a manner that is handy and helpful.

The present invention provides a system, system components and a method for helping and supporting a person to survive while performing some outdoor activities. The components and system include a releasable buckle (preferably composed of two parts); a flexible shield, and a flexible blade located inside the shield. The components and system are preferably formed into the shape of a bracelet system, and according to a preferred embodiment, a cord is wrapped around the shield to complete the bracelet system.

The bracelet a system, system components, and method is designed to be particularly helpful to help a person in a survival situation, because it helps the person improve his/her skills and/or increase his/her opportunity of survival while trapped in a difficult situation.

A particularly useful feature of the bracelet system is that the bracelet system is designed to be disassembled and the buckle parts reassembled with the blade to form a knife, with the buckle parts forming a handle of the knife, and the blade is coupled with the handle in a manner that stabilizes the blade and enables the blade to function as a knife. In addition, at least one of the buckle parts has a striker that enables the buckle part to function as a fire starter.

Still further, the buckle parts preferably include one or more (and more preferably all) of the following features:

a. COMPASS: This element is useful in a manner that can be used to direct a person and guiding his/her path, pointing to the right direction.

b. LED: This element is useful in a manner that can be used to help a person to see in darkness, to illuminates, is useful in a manner that can be use to make signals to call for help.

c. FERROCERIUM-ROD: This element is useful in a manner that can be used in conjunction with the Blade as a Fire-start kit, to make fire, campfire or bonfire in the event to heat, cook, warm up, keep away wilds, or some other purposes.

d. LOCKING-PIN: When the buckle parts form the handle of a knife, this element is useful in a manner that can be used to lock into an orifice of the blade, and keep the blade in place from sliding back and forward.

e. LOCKING-TAB. Moreover, when the buckle parts form the handle of a knife, this element is useful to hold and secure the back-end of the blade and prevent the blade from sliding sideways, thereby keeping the blade.

f. SLOT or opening: Still further, when the buckle parts form the handle of a knife, this element is useful in a manner that can be used to insert and guide the blade throughout the buckle resulting in the formation of the knife.

g. MIRROR: This element is useful in a manner that can be used to make sun-ray signals in the need to attract someone's attention.

h. WHISTLE: This element is useful in a manner that can be used as a rod-guide to align the male-part to the female-part to form the Buckle assembly, and is useful in a manner that can be used to whistle in the purpose of attract someone's attention, call for help, or some other purposes.

The blade that is inside the shield in a complete bracelet system, is formed of material that allows it to be flexible and malleable so that it will follow the roundness shape of the bracelet when is concealed inside of the shield, that is inside of the bracelet; and when the blade is removed from the bracelet system, its flexibility enables it to return to a substantially straight shape, which enables it to be coupled with the handle formed by the buckle parts to complete a knife. The blade preferably has (i) has a razor-like edge on its top, that can be used as part of the knife to perform different tasks (e.g. Cut, rip, tear, peel, carve, etc.), (ii) at the bottom edge part has a serration form, that can be used as a saw to perform different task. (e.g. Sawing); (iii) at its front end the blade has the shape of a hook, that can be used as a gut-cutter and some other purposes; (iv) at its front-top end the blade has a fishing hook shaped, that can be used as a fishing device; and at its rear-end the blade has an opening, also referred to as an orifice, that can be positioned into the locking-pin, through the handle formed by the buckle parts, to produce the knife and provide the buckle parts as a safety handle. The orifice can be used to attach the blade among with the cord's strings to build a fishing device.

The bracelet also, preferably includes a "D" RING that is useful in a manner that can be used to attach or hang small objects to the Bracelet that could be helpful and necessary. It hangs from the Shield.

The bracelet system also preferably includes COTTON LINT: that is useful in a manner that can be used as a igniters-primer to start a fire, since is impregnated with Petroleum jelly it makes it easy. Also, the PETROLEUM JELLY is useful in a manner that can be used to protect the blade from corrosion, and avoid losing sharpness, properties and strength. Also it is useful as fuel to start fire.

The shield is preferably formed as a flexible STRAP that is useful protecting the blade from exterior elements (Air, water, sun, dust, sweat). It also shapes the bracelet system, and the cord can be wrapped around to give strength to the bracelet system.

The Cord is useful in a manner that can be used to perform different task such tighten, tie, fasten, as a tourniquet, fishing line, as a bowstring, as a trigger for a snare trap, back-bone as a part of provisional shelter, etc. The reflective property of the cord can be used as a safety device to be noticed on the darkness. The Cord can be wrapped around the sharp surfaces of the blade to protect the hands of the person who uses it, and the back end can be used as part of a Striker to initiate Fire. In addition, the Cord is useful in a manner that when is wrapped around the Strap, it protects the Strap and the components inside of the Strap; makes the bracelet structure more sturdy, and gives a comfortable sensation when the bracelet is being worn. Cord makes the Bracelet structure sturdier.

Another aspect of the present invention is the manner in which the bracelet system can be disassembled, and some of its components reassembled to form the knife. The buckle parts form the handle of the knife, and the blade is attached to the handle, in the manner described above, and in the detailed description, to complete the knife.

One other aspect of the present invention is that components of the bracelet system can be used to provide The Fire-start Kit. One part of the fire starter kit is The Ferro cerium Rod which provides the sparks; The second part is The Blade, which becomes The Striker; the third part is The Cord, that is wrapped around the Blade, to provide a better grip and to protect the hands of the user; a fourth is the Cotton Lint, that, its function is to be an igniters-primer, that make it easier to ignite since is impregnated with, the fifth element, Petroleum jelly, that works as a fuel for the Fire.

Yet another aspect of the present invention is The Fishing-Kit, which can be formed from two parts of the bracelet system; One part is the Cord, using the inner Strands to form a fishing-line; Second part is the Blade, that can be use it as a fishing-hook; Tying up the Blade with the fishing line, both parts become in a fishing-kit.

Other aspect of the present invention will become apparent from the following detailed description and the accompanying drawing and exhibits.

BRIEF DESCRIPTION OF THE DRAWINGS AND EXHIBITS

FIGS. 11-14 are schematic illustrations of the system, including the system components, and the method by which the buckle assembly and the blade are coupled, showing the process how the knife assembly is formed from some of the elements that are part of the bracelet, according with the principles of the present invention.

Figure 21:
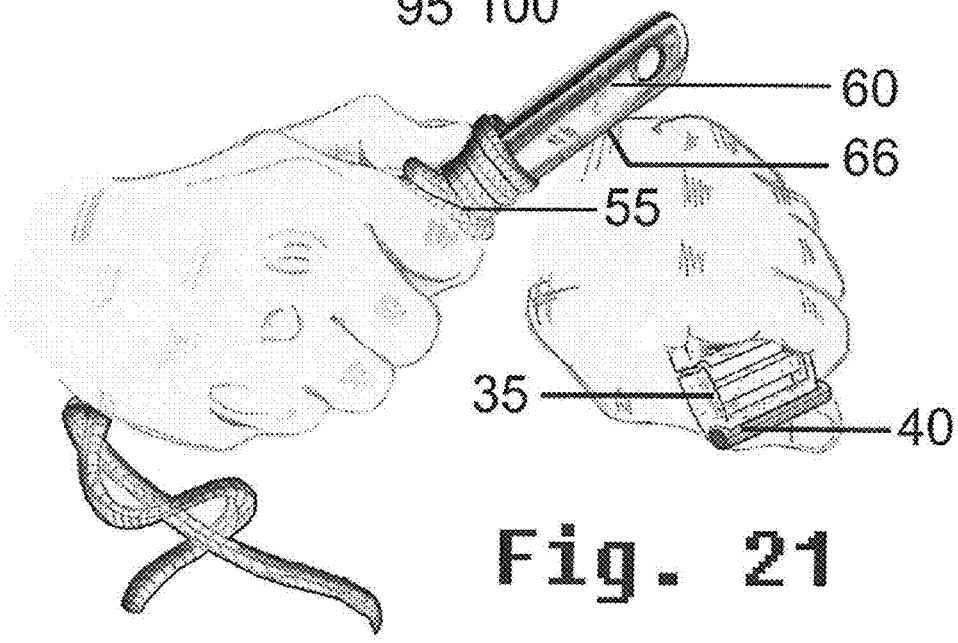

FIG. 21 is a schematic illustration of components the system, and the method by which the Buckle Assembly, the Blade, and the Cord altogether work as a Fire-Start Kit, showing the position and process how to initiate fire in a detailed view, the shape of the Buckle, Blade and Cord and their elements, and some of the elements that make up the bracelet, according with the principles of the present invention.

Figure 22:
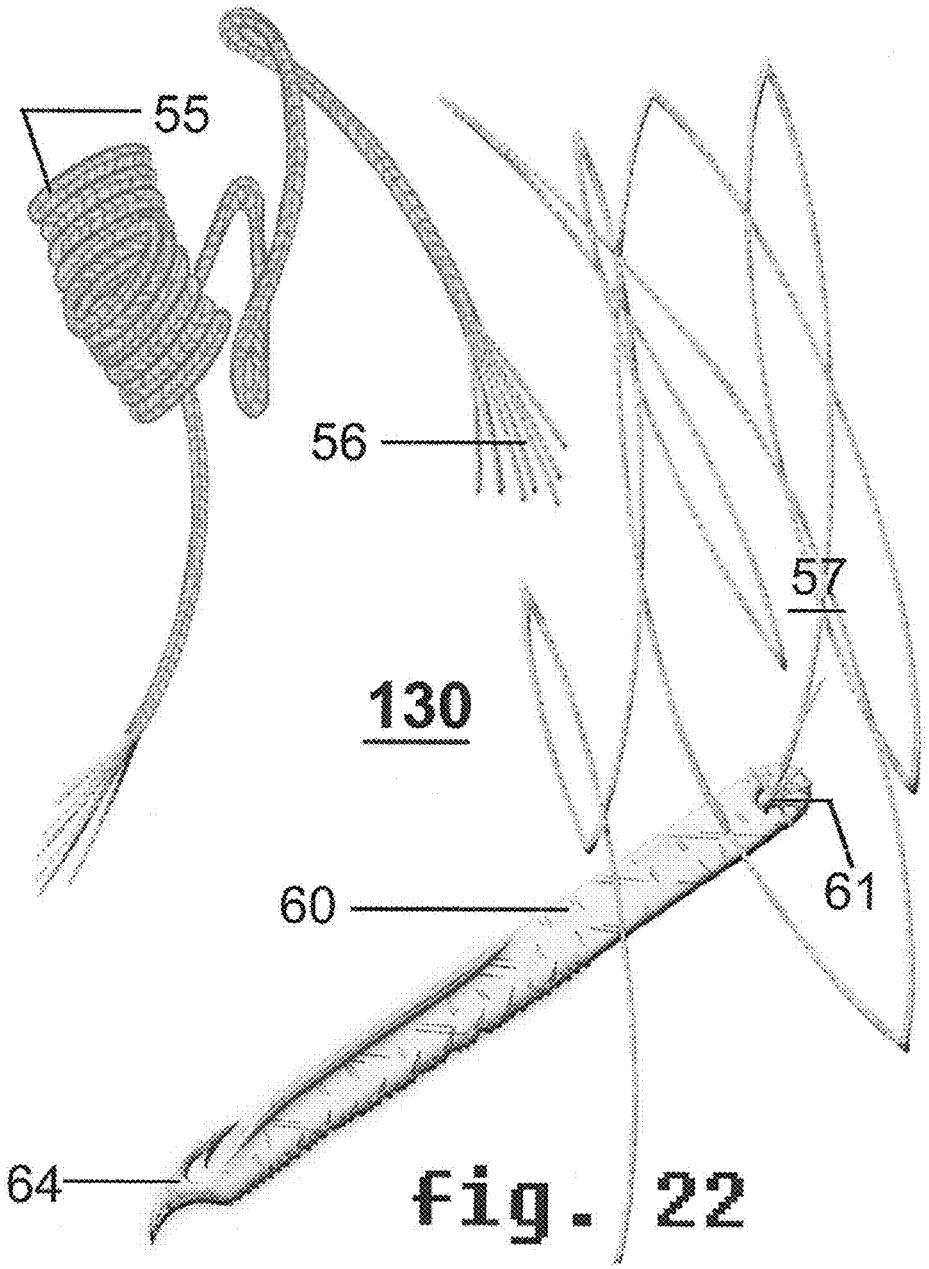

FIG. 22 is a schematic illustration of the configuration and assembly of the Fishing Kit (130) which is formed from two parts of the bracelet (1).

Exhibits A and B are a series of photographs showing the manner in which a Survival Bracelet's Prototype, according to the invention, is used.

DETAILED DESCRIPTION

As described above, the present invention relates to a new and useful system, method and components of a portable device (preferably a multi tool bracelet system) for helping a person to survive in certain situations at different scenarios when the person find him/herself trapped in while performing outdoor activities, in a manner that is efficient and effective, and in a manner that is designed in a compact and a low profile design, in a manner that is lightweight, comfortable and easy to wear it, in a manner that is handy and helpful. The principles of the invention are described herein in connection with a bracelet system, and from that description, the manner in which the principles of the invention can be applied to various devices will be apparent to these in the art.

Also, it should be noted that while a bracelet is typically a circular or oval structure designed to fit around a wearer's wrist, the principles of the invention can be applied to a device designed to fit about a number of human extremities or body parts (e.g. legs, waist, neck, head, torso in the manner of a sling, etc.). Thus, in this application, reference to a "bracelet" means a device that is configured to fit about a human extremity or body part, and be carried by a human in the same way a typical bracelet would fit about a human wrist and be carried by the human.

As illustrated in the figures, a system according to the invention includes a bracelet system (or assembly) 1 that is primarily formed by an assembly of various components: including a buckle assembly 50, flexible shield 65 (also referred to as a sheath) having a flexible blade 60 inside it, and preferably a cord 55 wrapped about the sheath 65.

The buckle assembly 50 preferably has a number of system components on its body, such as are: Compass 10; LED Light ON/OFF Switch 15; LED Lights 20; Locking Pin 25; Locking Tab 30; Buckle Male-part 35; Ferro cerium Rod 40; Buckle Female-part 45; Mirror 70 that is located in the bottom side of the buckle assembly; Opening Slot 75; Opening 90; And Whistle 80 as part of the Buckle Assembly 50. The buckle assembly is in connection with the ends of the Shield 65, which holds the Cord 55 that can be wrapped around Shield 65, and gives shape to the Bracelet 1. The shield 65 holds and keeps hanging in place the "D" Ring 85; and holds and keeps inside the Blade 60 to protect the blade 60 from the outside corrosive elements that could damage the Blade 60. One other element inside the buckle assembly is Cotton Lint 95, that is useful as an igniters-primer, that make it easier to ignite since is impregnated with, other element, Petroleum jelly 100 (FIG. 20), that works as a fuel for the Fire, and protects the Blade 60 from corrosion.

As described above the present invention relates to a new and useful System, System Components and Method. Some of the components or elements of the Bracelet 1, when the bracelet is disassembly, are assembled or used together to provide the following configurations; according to the principles of the present invention Knife assembly 110, can be formed by assembling two parts of the Bracelet 1; one part is the buckle assembly 50 which in this particular configuration becomes the Handle of the knife, and the second part is the Blade 60, producing as a result The Knife assembly 110 (FIG. 14) which is a very useful and handy device.

Figure 20:
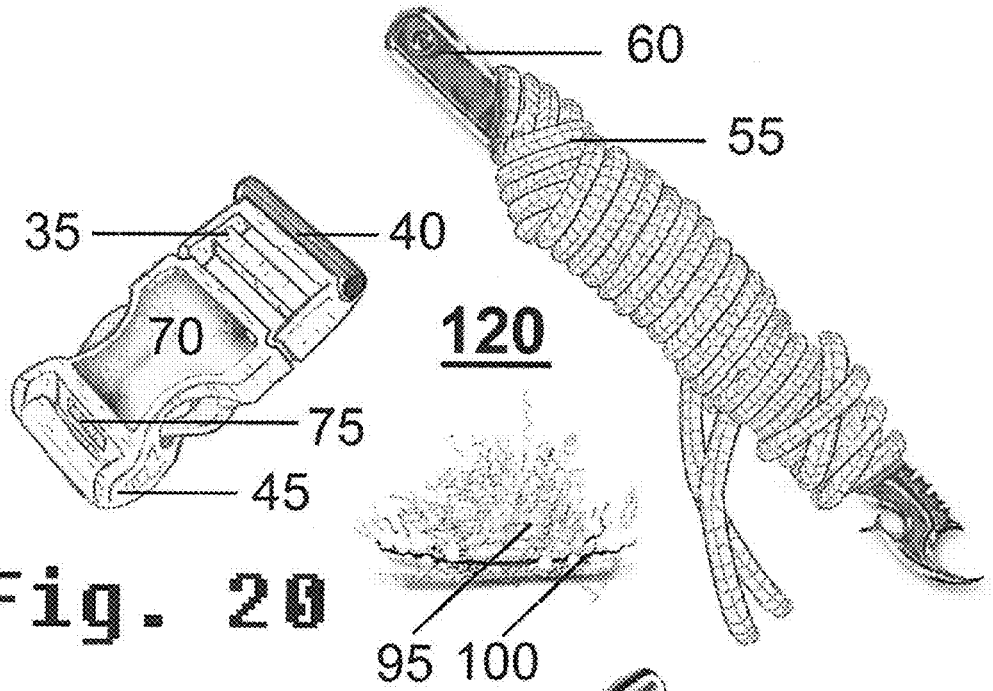
FIG. 20 is a schematic illustration of components of the system, and the method by which the Buckle Assembly, the Blade, and the Cord are further utilized, according with the principles of the present invention.

Another configuration that can be formed from components of the bracelet system of the present invention is The Fire-start Kit 120 (FIG. 20). The fire start kit is formed from five elements of the Bracelet 1; One part is The Ferro cerium Rod 40 which provides the sparks; The second part is The Blade 60 which becomes The Striker; the third part is The Cord 55, that is wrapped around the Blade, to provide a better grip and to protect the hands of the user; Four element is Cotton Lint 95, that, its function is to be an igniters-primer, that make it easier to ignite since is impregnated with, the fifth element, Petroleum jelly 100, that works as a fuel for the Fire.

Yet another device that can be formed from components of a bracelet system of the present invention is The Fishing-Kit 130 (FIG. 22). The fishing kit is formed from two parts of the Bracelet 1; One part is the Cord 55, using the inner Strands 56 to form a fishing-line 57; The Second part is the Blade 60, that can be use it as a fishing-hook 43; Tying up the Blade 60 by the Orifice 61 with the fishing line 57, both parts turn into a fishing-kit 130.

Figure 1:
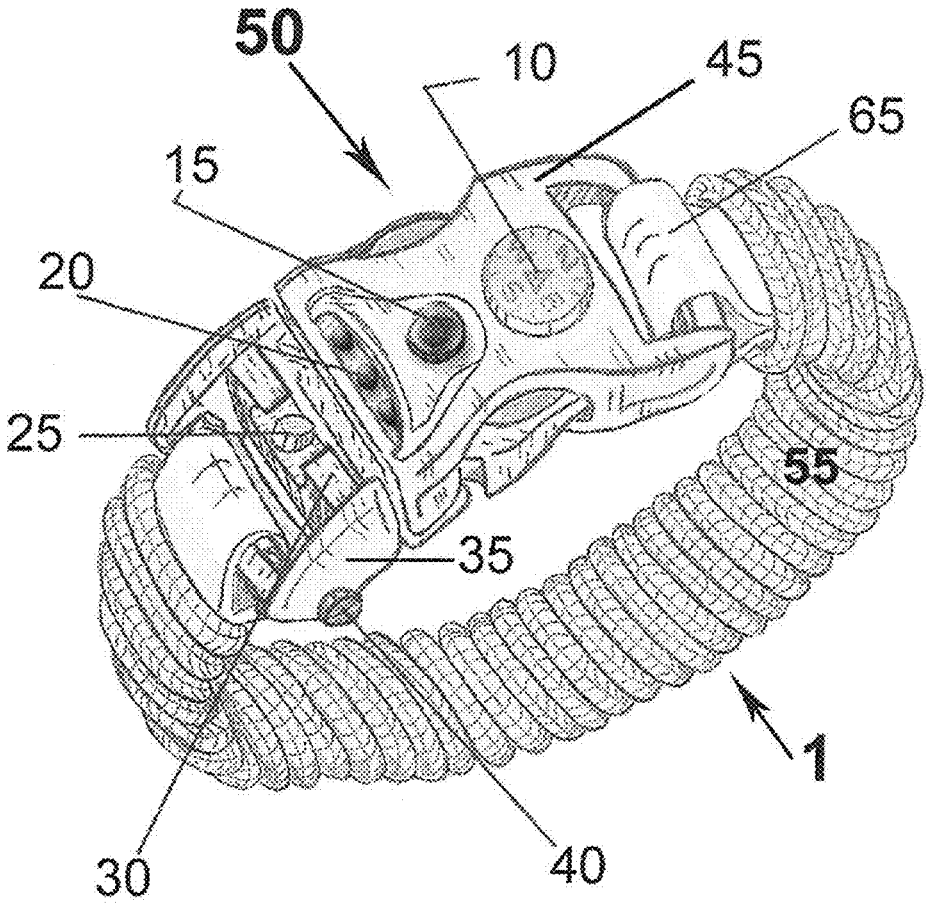
FIG. 1 is a schematic illustration of the bracelet system, including the system components, and the method by which the bracelet is formed, the shape of the bracelet in a closed position, and some of the elements that make up the bracelet, according with the principles of the present invention, are exhibiting.

As described above, FIG. 1 illustrates some of the components or elements that are part of the Bracelet (1), that is showing in a closed position, The components are: Male-part (35) and Female-part (45) these two elements form the Buckle Assembly (50); others elements are:

a. COMPASS (10): This element is useful in a manner that can be used to direct a person and guiding his/her path, pointing to the right direction.
b. LED ON/OFF Switch (15), This element controls the LED lights
c. L.E.D. Light (20): This element is useful in a manner that can be used to help a person to see in darkness, to illuminates, is useful in a manner that can be used to make signals to call for help.
d. LOCKING-PIN (25): This element is useful in a manner that can be used to lock into the Orifice (61) of the Blade (60), and keep the Blade (60) in place from sliding back and forward.
e. LOCKING-TAB (30): This element is useful in a manner that can be used to hold and secure the Back-end of the Blade (60) and prevent the Blade (60) from slide to the sideways and keep it in place.
f. FERROCERIUM-ROD (40): This element is useful in a manner that can be used in conjunction with the Blade (60) as a Fire-start kit (120), to make fire, campfire or bonfire in the event to heat, cook, warm up, keep away wilds, or some other purposes.
g. shield (65): As a Shield this element is useful in a manner that can be used to protect the Blade (60) from exterior elements (water, sun, dust, sweat). It shapes Bracelet (1), Cord (55) can be wrapped around to add strength to the Bracelet (1).
h. CORD (55): This element is useful in a manner that can be used to perform different task such tighten, tie, fasten, as a tourniquet, fishing line, as a bowstring, as a trigger for a snare trap, back-bone as a part of provisional shelter, etc. The reflective optional property of the cord (55), can be used as a safety device to be noticed on the darkness.

Cord (55) can be wrapped around the sharp surfaces of the blade (60) to protect the hands of the person whose use it, and use the back end part as a Striker (66) to initiate fire. Cord (55) is useful in a manner that, when is wrapped around the Shield (65) it protects the Shield (65) and the components that are inside of it, it gives a comfortable cushion sensation when is wearing it; Cord (55) makes the Bracelet's (1) structure more sturdy.

Figure 2:
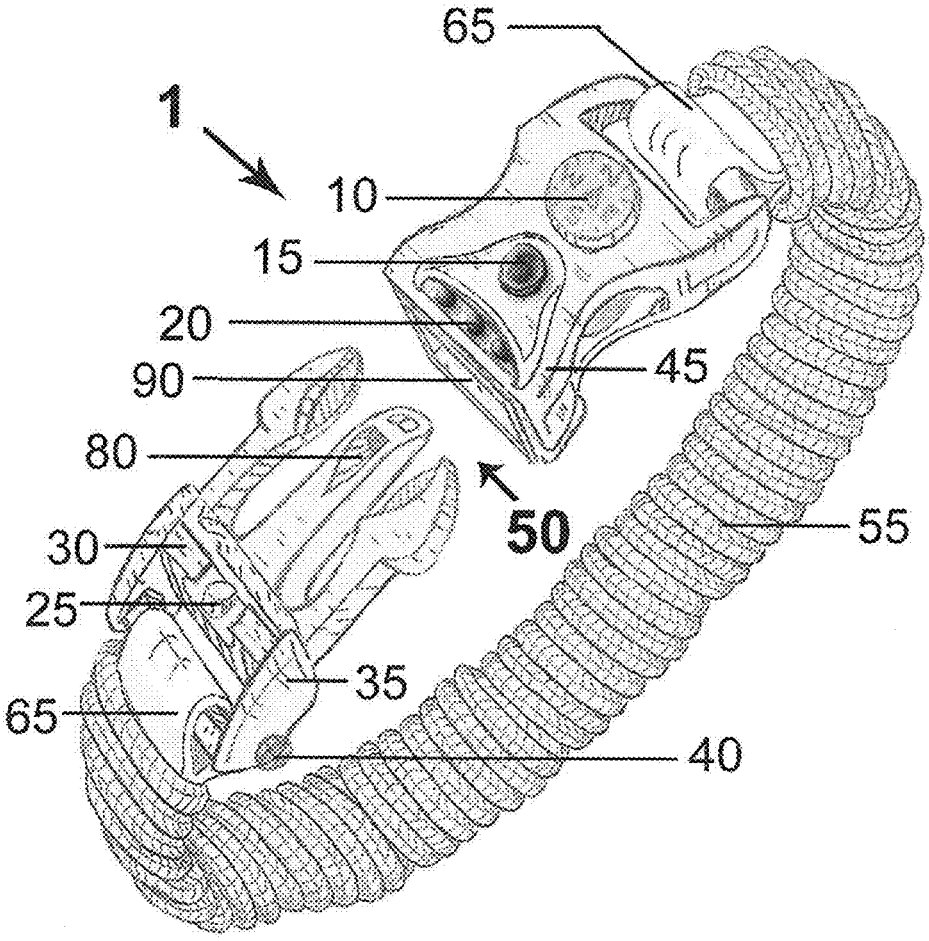
FIG. 2 is a schematic illustration of the system, including the system components, and the method by which the bracelet is formed, the shape of the bracelet in opened position, and some of the elements that make up the bracelet, according with the principles of the present invention, are exhibiting.

FIG. 2 is a schematic isometric illustration of the configuration and assembly, of Bracelet (1) showing it in a open position, according to the present invention. The system comprises the following components: Male-part (35) which is exhibiting the Whistle (80) this element is useful in a manner that can be used as a rod-guide to align the male-part (35) to the female-part (45) to form the Buckle assembly (50); and is useful in a manner that can be used to whistle in the purpose of attract someone's attention, call for help, or some other purposes; another elements, Locking pin (25), Locking tab (30), Ferro Cerium Rod (40), one end of Shield (65) this and the others element mentioned are partially or completely in contact with Male part (35). One other component is Female-part (45) which is exhibiting the elements Compass (10), LED switch (15), LED Lights (20), Opening (90), one other side-end of the Shield (65) this and the elements mentioned are partially or completely in contact with Female-part (45). Other component is Cord (55) which its importance has been mentioned above in FIG. 1 description according with the principles of the present invention.

Figure 3:
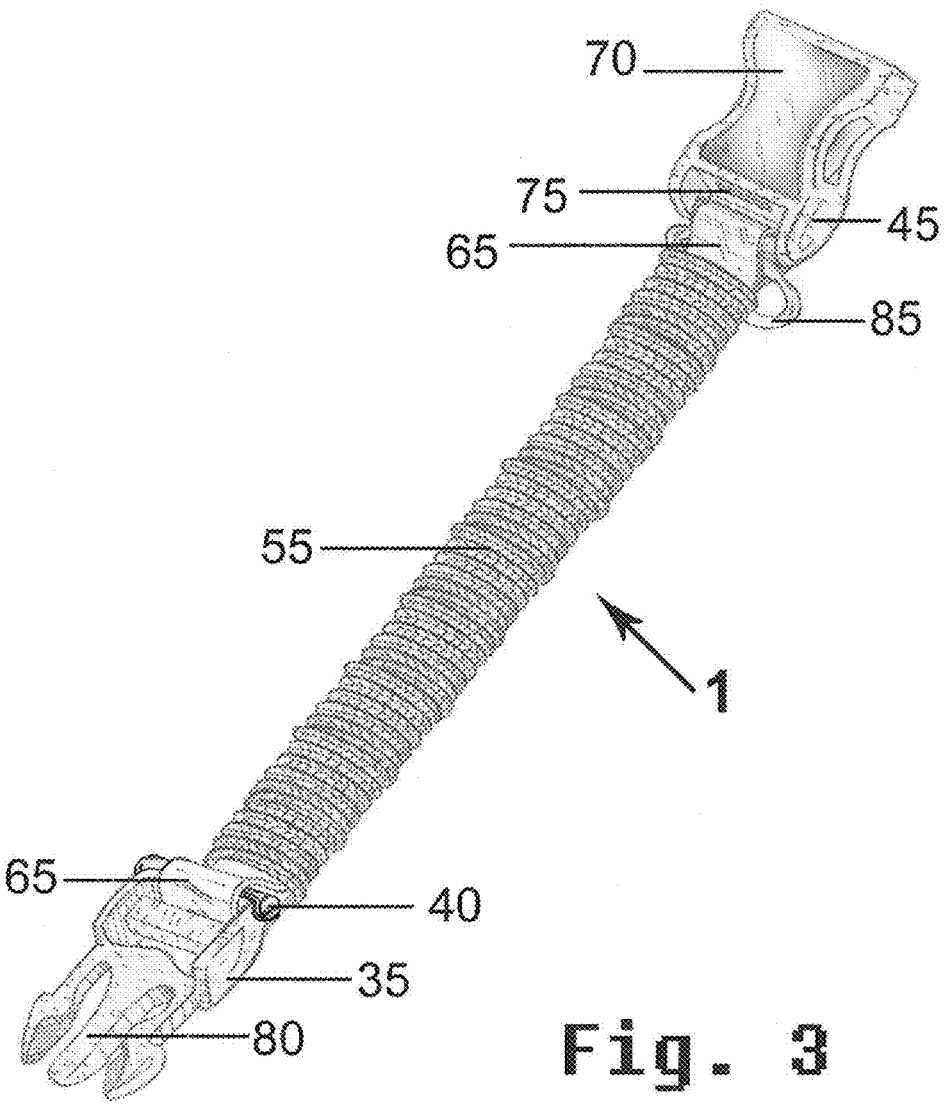
FIG. 3 is a schematic illustration of the system, including the system components, and the method by which the bracelet is formed, the shape of the bracelet in flat and extended position, and some of the elements that make up the bracelet, according with the principles of the present invention, are exhibiting.

FIG. 3 is a schematic isometric illustration of the configuration and assembly, of the Bracelet (1) showing it in a Extended/Flat position, according to the present invention. The system comprises the following components: Male-part (35) which is exhibiting the bottom part of the Whistle (80), Ferro Cerium Rod (40), side-end of the Shield (65), and all of these elements are partially formed with or coupled with the Male-part (35).

Female-part (45) which includes the Mirror (70). This element is useful in a manner that can be used make sun-ray signals in the need to attract someone's attention, and some other purposes; its unique low profile shape and location makes it, very handy tool. Some others elements are: "D" Ring (85) this element is useful in a manner that can be used to attach or hang small objects to the Bracelet (1) that could be helpful and necessary. It hangs from the Shield (65) that is partially connected to Female part (45) in which Slot (75) opening is located and its function is to align and guide the Blade (60) when the Knife-assembly (110) it is forming. Other component is Cord (55) which its importance has been mentioned above in FIG. 1's description, according with the principles of the present invention.

Figure 4:
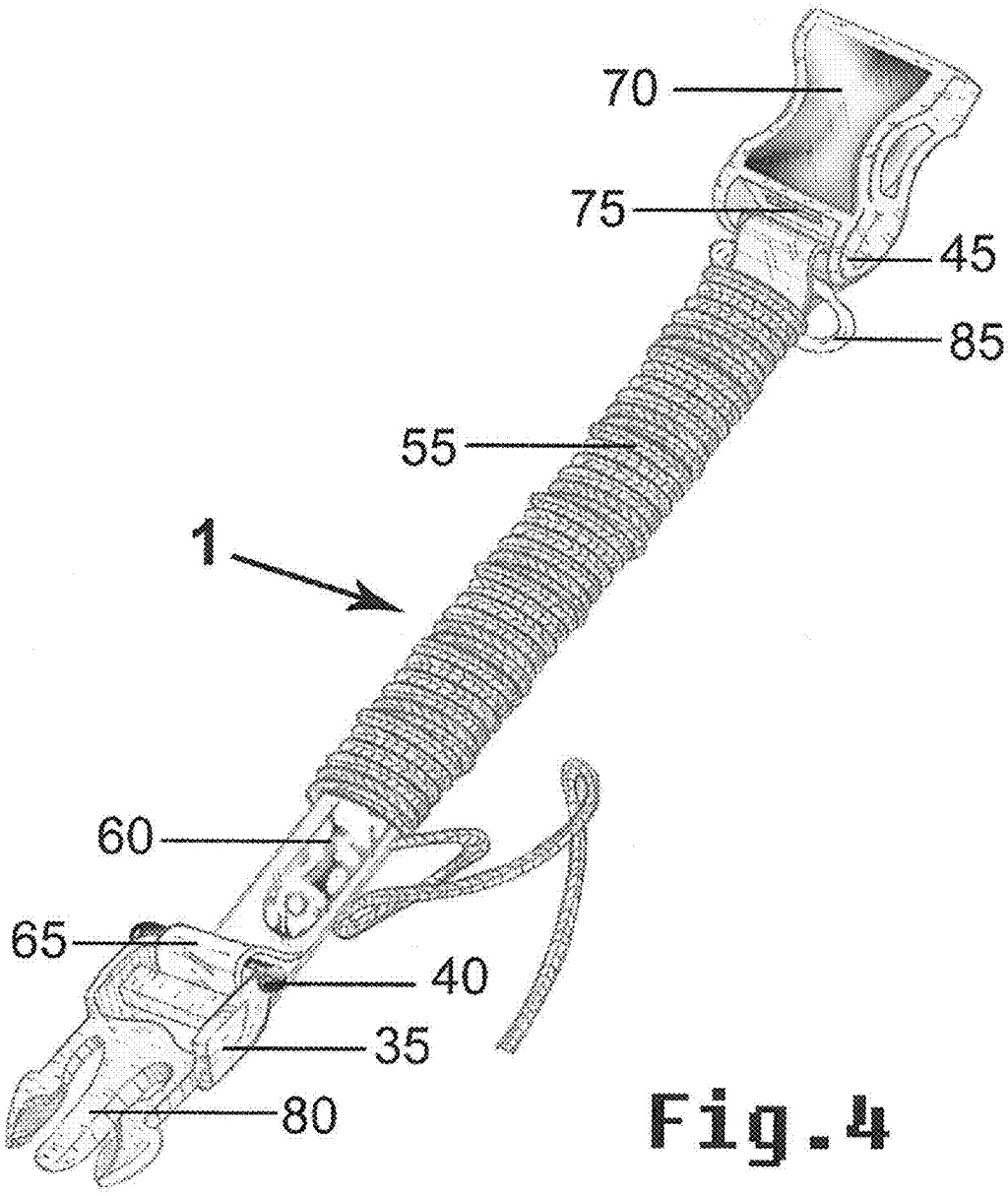
FIG. 4 is a schematic illustration of the system, including the system components, and the method by which the bracelet is formed, the shape of the bracelet in flat and extended position, and some of the elements that make up the bracelet, according with the principles of the present invention, are exhibiting.

FIG. 4 is a schematic isometric illustration of the configuration and assembly, of the Bracelet (1) showing it in an Extended/Flat Cord peeling position, according to the present invention. The system comprises the same elements of FIG. 3. And showing the component Blade (60) and some part of element Shield (65), according with the principles of the present invention.

Figure 5:
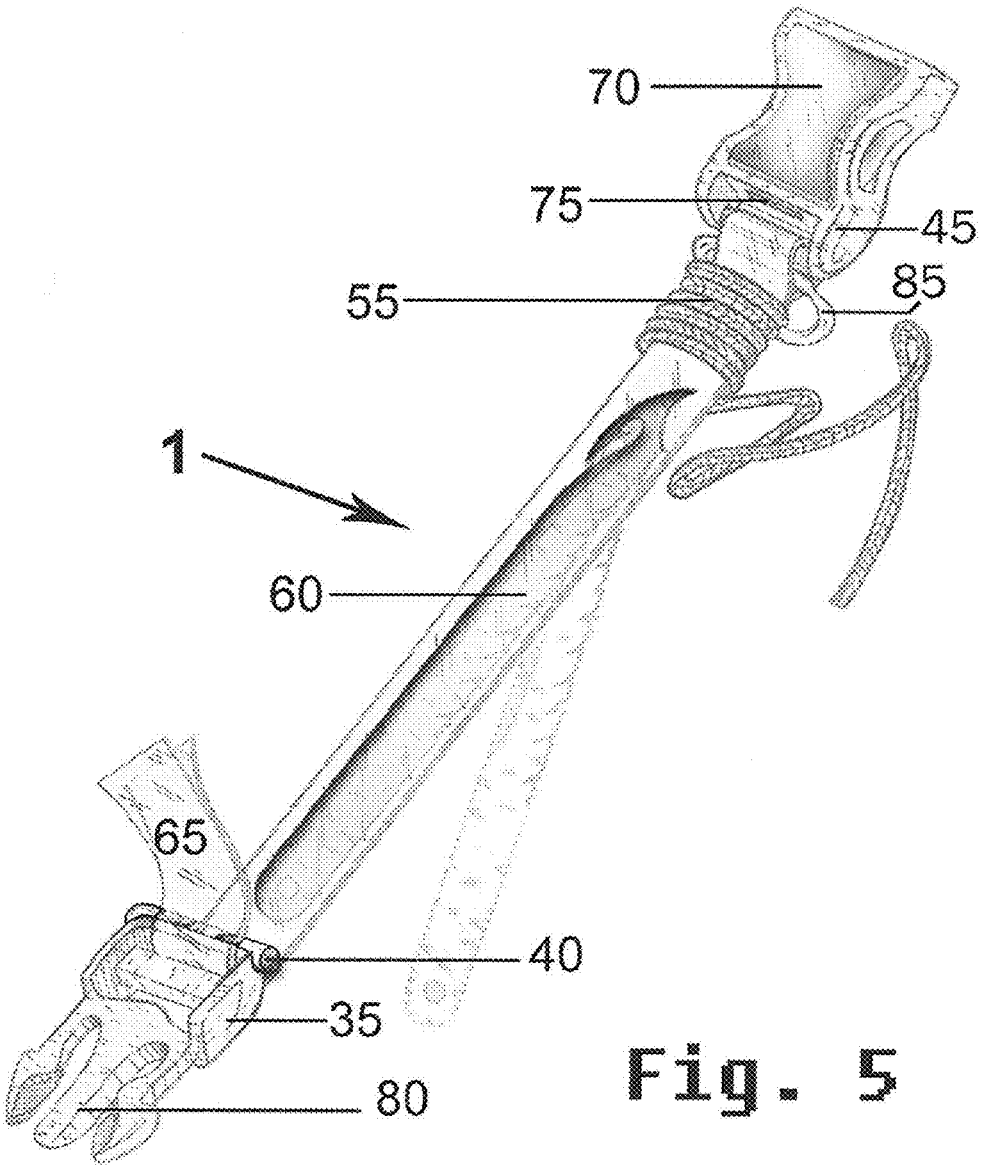
FIG. 5 is a schematic illustration of the system, including the system components, and the method by which the bracelet is formed, the shape of the bracelet in flat, extended, unwrapped and disassembled position, and some of the elements that make up the bracelet, according with the principles of the present invention, are exhibiting.

FIG. 5 is a schematic isometric illustration of the configuration and assembly, of the Bracelet (1) showing it in a Extended/Flat and Blade exposed position, according to the present invention. The system comprises the same elements of FIG. 3, and shows the component Blade (60) inside and outside of the Shield (65), according to the present invention.

Figure 6:
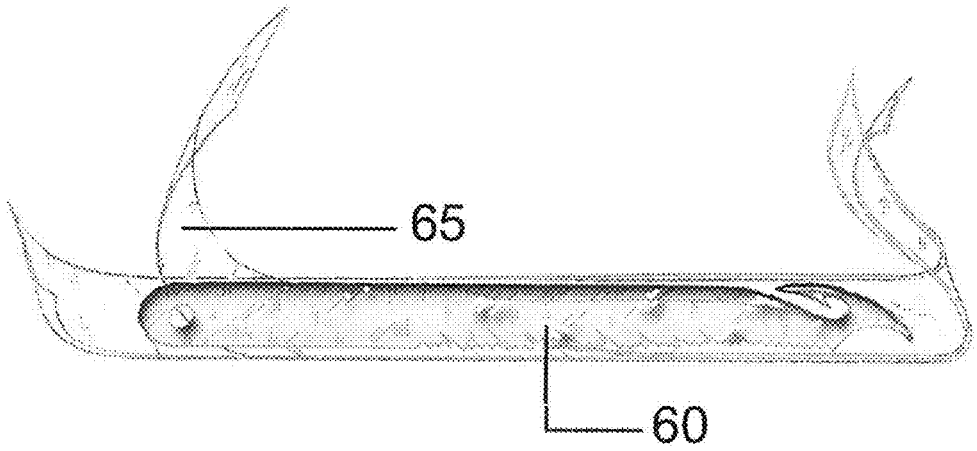
FIGS. 6-7 are schematic illustrations of the system, including the system components, and the method by which showing some of the elements that make up the bracelet, the position of the blade inside and outside of the shield, according with the principles of the present invention.
Figure 7:
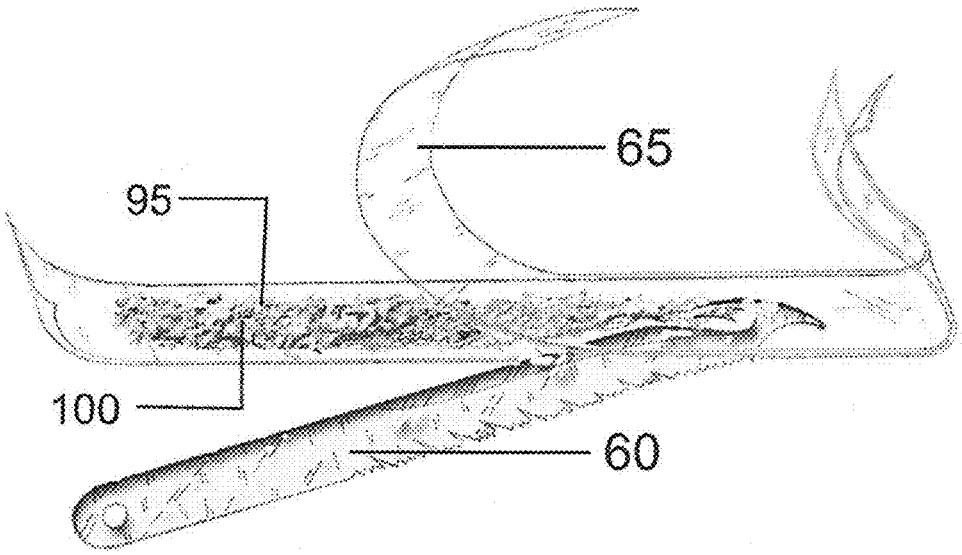

FIGS. 6, 7 are schematic isometric illustrations of the configuration and assembly, of the Shield (65) showing the component Blade (60) inside and outside position, and also showing where Cotton Lint (95) and Petroleum Jelly (100) are located.

Figure 8:
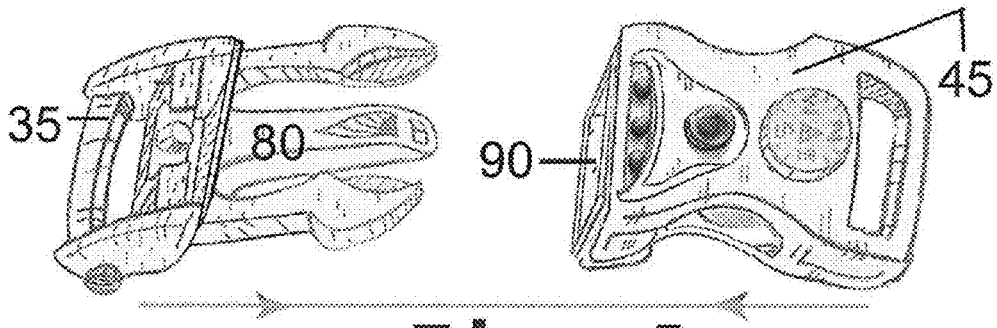
FIGS. 8-10 are schematic illustrations of the system, including the system components, and the method by which the male-part and female part of the buckle are showing the process how the Buckle Assembly is formed and showing some of the elements that are part of the Bracelet, according with the principles of the present invention.
Figure 9:
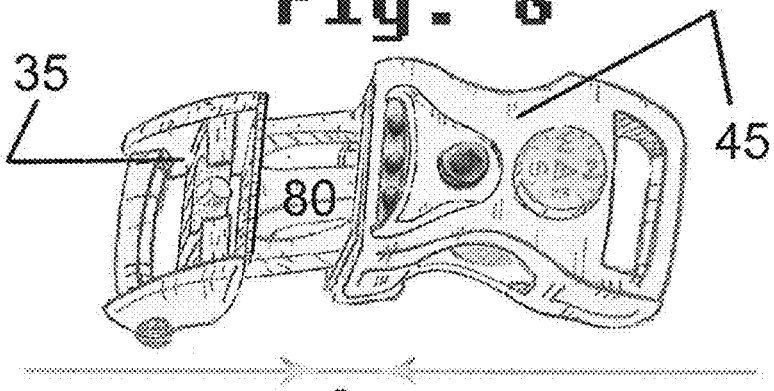
Figure 10:
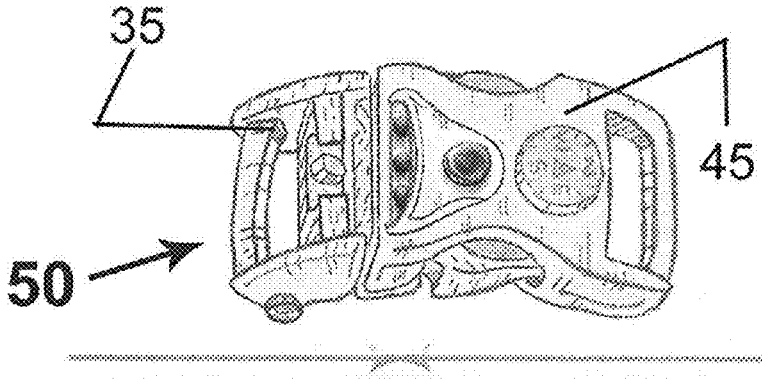

FIGS. 8, 9 and 10 are schematic isometric illustrations of the configuration and assembly, of the Male-part (35) and Female-part (45), approaching each other, and the moment when element Whistle (80) works as a guide and enters into the Opening (90) of the female part, to lock its position; and showing the process of how the Buckle assembly (50) is taking shape, and its final result as showing in FIG. 10, according with the principles of the present invention.

FIG. 11, is a schematic isometric illustration of the configuration and assembly, of a detailed View, displaying the process of forming the Knife assembly (110), when the back part of the Blade (60), specifically the element Orifice (61) is engaging with element Locking pin (25) and simultaneously entering in contact with Locking tab (30), in order to secure the Blade (60) to the buckle assembly (50) that forms the handle of the knife.

Figures 12, 13, 14:
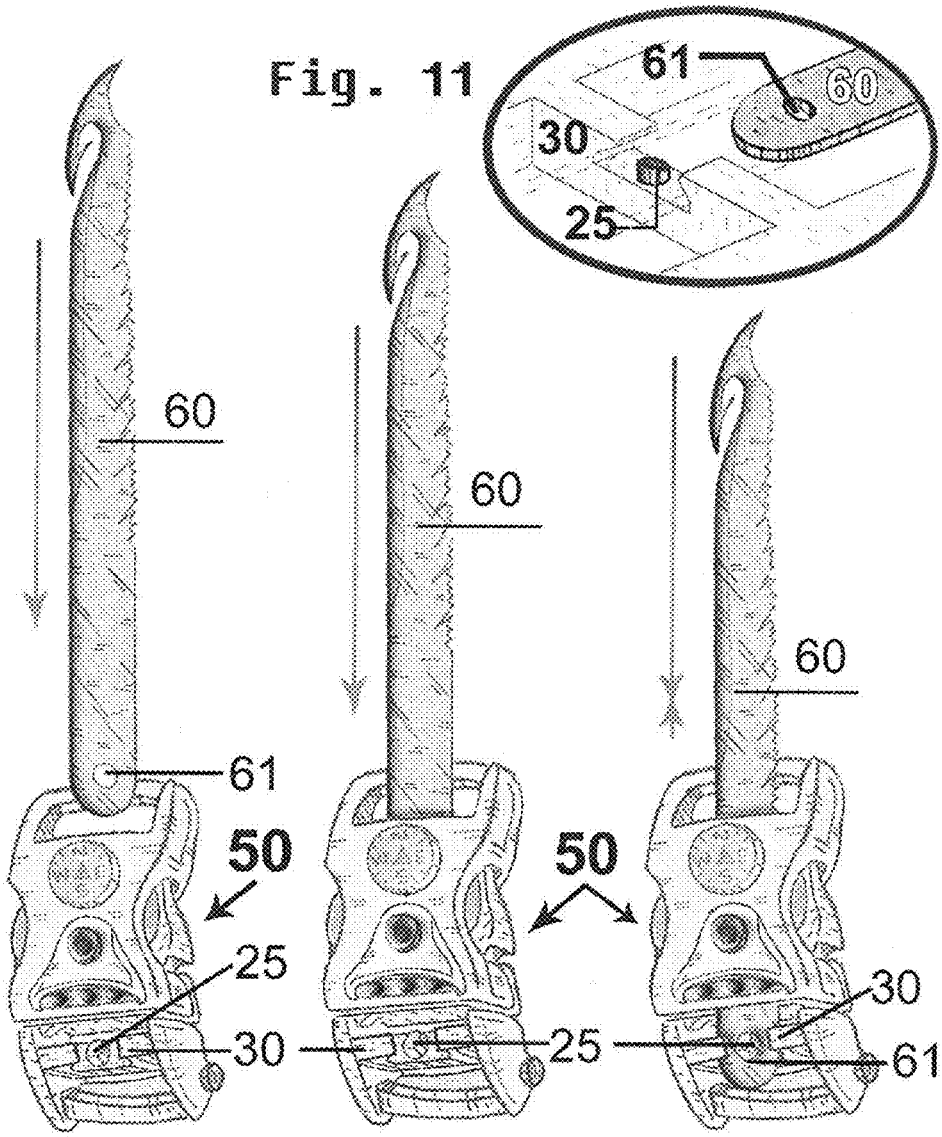

FIGS. 12, 13 and 14 are schematic isometric illustrations of the configuration and assembly of the assembly of the knife from components of the bracelet system. The figures show the process of the Knife assembly (110), showing when the Blade (60) is passing through the Buckle Assembly (50), and displaying specifically the moment when the Orifice (61) is engaging with Locking pin (25) and simultaneously entering in contact with Locking tab (30), in order to secure the Blade (60). Those figures also show how Knife assembly (110) is taking shape, and its final result is shown in FIG. 14, according with the principles of the present invention FIGS. 8, 9, 10, 11, 12, 13 and 14 are schematic isometric illustrations of the configuration and assembly of the knife from components of the bracelet system, exhibiting step by step the process of the forming the Knife assembly (110), how it is assembled, how it takes shape, from the beginning till its final result as shown in FIG. 14, according to the principles of the present invention.

Figure 15:
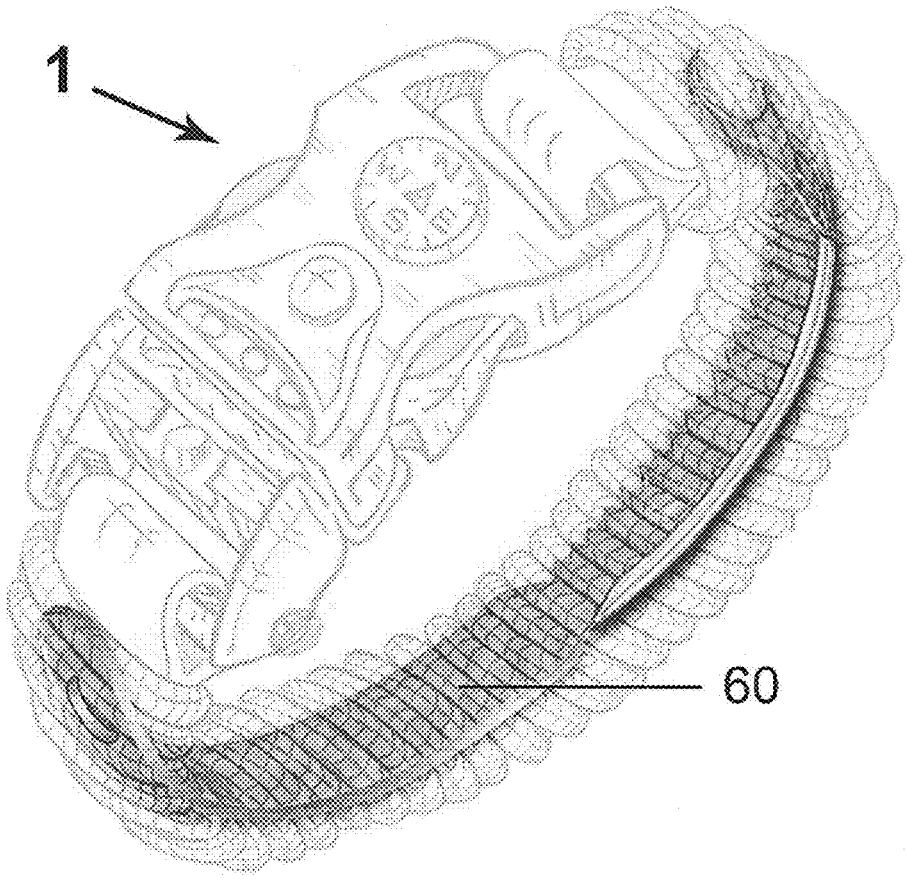
FIG. 15 is a schematic illustration of the system, including the system components, and the method by which the bracelet is formed, showing in a ghosted view the shape of the blade inside the bracelet and its roundness position, and some of the elements that make up the bracelet, according with the principles of the present invention.

FIG. 15 is a schematic isometric illustration of the bracelet system, in a detailed ghosted view (transparent) of the Bracelet (1), wherein the Blade (60), its location and storage inside the shield (65) are illustrated, and also illustrating how the blade (60) takes the curved or rounded shape of the Bracelet (1), and also how the shield (65) keeps the blade (60) secure, and in a safe place.

Figure 16:
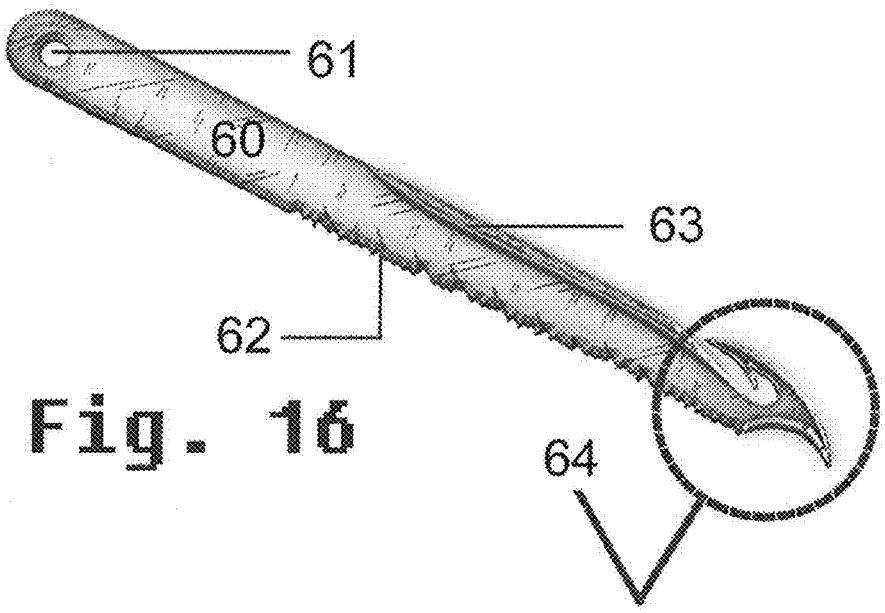
FIG. 16 is a schematic illustration of the system, including the system components, and the manner in which the blade is configured, showing in a detailed view, the shape of the Blade and its elements, and some of the elements that make up the bracelet, according with the principles of the present invention.

FIG. 16 is an isometric illustration of the of the Blade (60), The blade includes Orifice (61) which functions to secure and keep in place Blade (60) once is engaged with Locking pin (25)) and simultaneously entering in contact with Locking tab (30). Other functions of the orifice (61) can be used is to tie a fishing line (57), to use Blade's (60) Fishing Hook (64). The blade includes the Razor-sharp Edge (63); And Serration Edge (62), according to the principles of the present invention.

Figure 17:
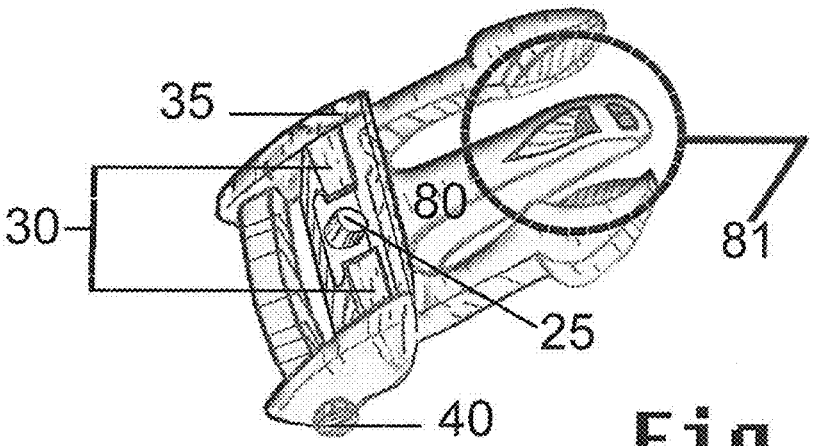
FIG. 17 is a schematic illustration of the male buckle part of the system, including the shape of the buckle part and its elements, according with the principles of the present invention.

FIG. 17 is a schematic isometric illustration of the configuration and assembly, of the Male-part (35), exhibiting in detail the following elements: Locking pin (25); Locking tab (30); Ferro cerium Rod (40); Whistle (80) and its Mouth piece (81) wherein the air is forced to enter and expelled, in order to produce a noise. The rest of the elements with theirs functions and description were mentioned above according with the principles of present invention.

Figure 18:
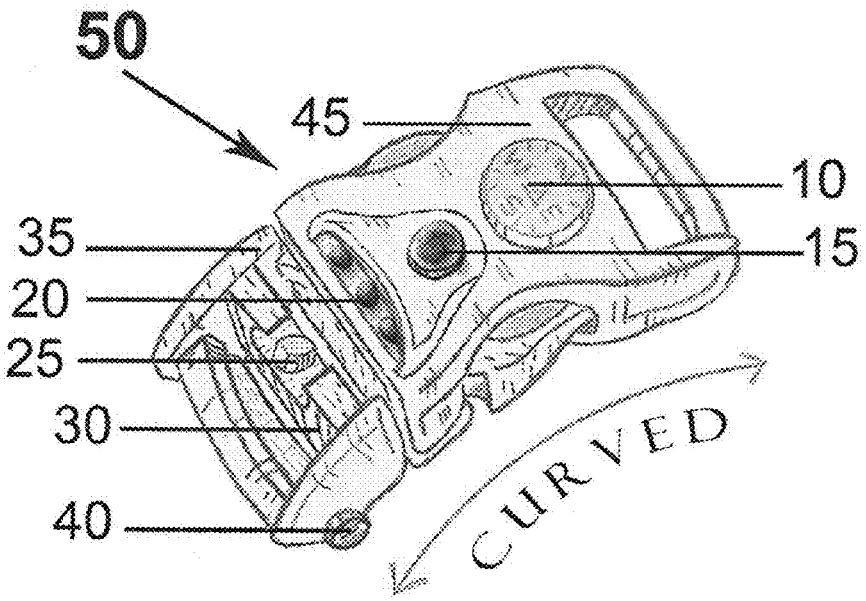
FIG. 18 is a schematic illustration of components of the system, and the method by which the Male-part and female-part are joined forming the Buckle Assembly, and particularly showing in a detailed upper view, the shape of the buckle and its elements, and some of the elements that make up the Bracelet, according with the principles of the present invention.
Figure 19:
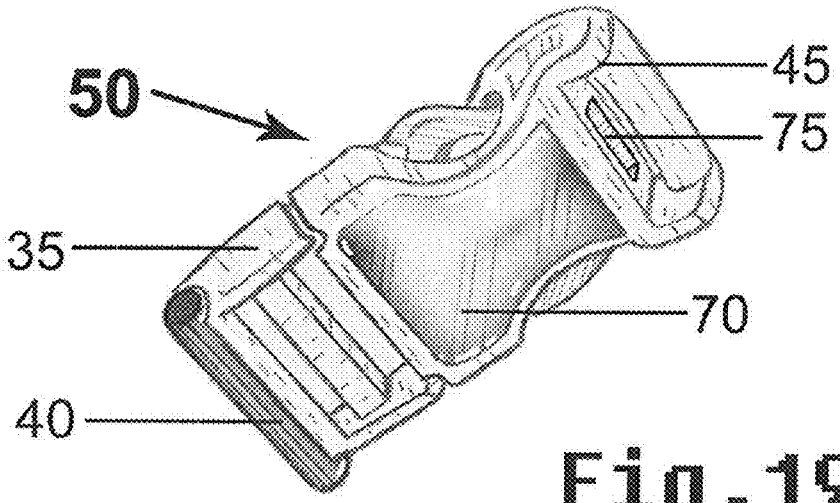
FIG. 19 is a schematic illustration of components of the system, and the method by which the Male-part and female-part are joined forming the Buckle Assembly showing in a detailed bottom view, the shape of the Buckle and its elements, and some of the elements that make up the Bracelet, according with the principles of the present invention.

FIGS. 18 and 19 are schematic isometric illustrations of the configuration and assembly, of the Buckle Assembly (50) which comprises the following elements: Compass (10); Switch ON/OFF (15); LED Lights (20); Locking pin (25); Locking tab (30); Buckle Male-part (35); Ferro Cerium Rod (40); Buckle Female-part (45). Mirror (70); Slot opening (75). Is exhibiting the Curved shape of the Buckle Assembly (50), with the purpose to follow the curved shape of the Strap (65) to form an Orbed-shape Bracelet (1), (see FIG. 1), that will fit on the contour of the wrist of a Person. The function and description of the elements are mentioned above according with the principles of the present invention.

FIG. 20 is a schematic illustration of the configuration and assembly of the Fire-start Kit (120), which is formed from five of the components of the Bracelet. One part is The Ferro cerium Rod (40) which provides the sparks; The second part is the Blade (60), which becomes The Striker; the third part is the Cord (55), that is wrapped around the Blade, to provide a better grip and to protect the hands of the user; fourth Cotton Lint (95), that, its function is to be an igniters-primer, that make it easier to ignite since is impregnated with, the fifth element, Petroleum jelly (100), that works as a fuel for the Fire. FIG. 21 is a schematic illustration of the configuration and assembly of the Fire-start Kit (120), exhibiting the position of the Hands of the person, the proper way to take the components involved in this process and the adequately form to use it. A unique process that involves: Blade (60) that can be grabbed by the Cord (55) that is wrapped around Blade (60) to protect user's hands, wherein flat-side (66) of the Blade (60) is exposed, for the reason, that this section is which hit the Ferro cerium Rod (40) in order to generate the Sparks that ignites the Fire; according to the principles of the present invention.

FIG. 22 Is a schematic illustration of the configuration and assembly of the Fishing Kit (130) which is formed from two parts of the Bracelet (1). One part is the Cord (55), using the inner Strands (56) to form a fishing-line (57); The Second part is the Blade (60), that can be use it as a fishing-hook (64); By tying up the Blade (60) by the Orifice (61) with the fishing line (57), both parts turn into a fishing-kit (130). according with the principles of the present invention.

Thus, applicant has described herein a utility bracelet system and related assembly method, in which a flexible shield (also called the sheath or protective shield) has an interior for receipt of a flexible blade, mating buckle parts coupled with respective ends of the flexible sheath and configured to be releasably coupled together to form the flexible shield into the shape of a bracelet, and a flexible blade located in the interior of the flexible shield, the flexible blade having a flexibility and malleability that enables it to conform to the configuration of the flexible shield when the shield is formed into the shape of a bracelet. In a preferred embodiment, a cord is wrapped about the flexible shield that is formed into the shape of a bracelet, so that the cord forms the exterior of the bracelet assembly. The bracelet system is designed to be disassembled and the buckle parts reassembled with the blade to form a knife, with the buckle parts forming a handle of the knife, and the blade coupled with the handle in a manner that stabilizes the blade and enables the blade to function as a knife. In addition, when the bracelet system is disassembled, certain of its components can be formed into a fire start kit, or certain components formed into a fishing kit. With the foregoing disclosure in mind, the manner in which a bracelet system can be designed, assembled, disassembled, and its components reassembled into various other useful devices will be apparent to those in the art.

The invention claimed is:

1. A utility bracelet system comprising a. a flexible shield with an interior for receipt of a flexible blade, b. mating buckle parts coupled with respective ends of the flexible shield and configured to be releasably coupled together to form the flexible shield into the shape of a bracelet, and c. a flexible blade located in the interior of the flexible shield, the flexible blade having a flexibility and malleability that enables it to conform to the configuration of the flexible shield when the sheath is formed into the shape of a bracelet;

d. a cord wrapped about the flexible shield so that the cord forms an exterior of the bracelet system;

wherein the bracelet system is designed to be disassembled and the buckle parts reassembled with the blade to form a knife, with the buckle parts forming a handle of the knife, and the blade is coupled with the handle in a manner that stabilizes the blade and enables the blade to function as a knife, and wherein at least one of the buckle parts has a striker that enables the buckle part to function as a fire starter.

2. The system of claim 1, wherein the buckle parts include any or all of the following a. mirror, b. compass, c. an LED providing a source of illumination, and/or d. a whistle formed in one piece with one of the buckle parts.

3. The system of claim 1, wherein the blade has an orifice at its back end, one of the buckle parts includes a locking pin configured to lock into the orifice of the blade, and keep the blade in place from sliding back and forward, a locking tab configured to hold and secure the back-end of the blade and prevent the blade from sliding sideways, thereby keeping the blade stable, and a slot or opening configured to receive to insert and guide the blade into the buckle parts forming the handle.

4. A method of providing a utility bracelet system comprising a. providing a flexible shield having two opposite ends and an interior, b. providing two mating buckle parts, each coupled with one end of the flexible shield and configured to be releasably coupled together to form a bracelet, and c. providing a flexible blade in the interior of the flexible shield, the flexible blade having a flexibility that enables it to conform to the shape of a bracelet, d. wrapping a cord about the flexible shield so that the cord forms an exterior of the bracelet assembly;

wherein the bracelet system includes a striker material coupled with one of the buckle parts, and cotton lint and petroleum jelly protecting the blade, wherein the bracelet is disassembled and the blade, the cord and the buckle part having the striker material, the cotton lint and the petroleum are assembled into a fire start kit.

5. A method of providing a utility bracelet system comprising a. providing a flexible shield with an interior for receipt of a flexible blade, b. providing mating buckle parts coupled with respective ends of the flexible shield and configured to be releasably coupled together to form the flexible shield into the shape of a bracelet, and c. providing a flexible blade located in the interior of the flexible shield, the flexible blade having a flexibility that enables it to conform to the configuration of the flexible shield when the shield is formed into the shape of a bracelet, d. wrapping a cord about the flexible shield so that the cord forms an exterior of the bracelet assembly;

wherein the blade includes a hook portion, and the cord includes a plurality of strands, wherein the bracelet is disassembled and the blade, and the strands of the cord are assembled into a fishing kit.

6. A multi tool bracelet, comprising:

a. a releasable buckle assembly having a male part and a female part;

b. a shield, having two opposite ends, one end connected to the male part and the opposite end connected to the female part;

c. a cord wrapped around the shield;

d. a compass coupled with the female part of the buckle assembly, e. an LED light casing is coupled with the female part of the buckle assembly, f. an LED light control switch coupled with one part of the buckle assembly, g. an opening provided at a front of the female part to accept the male part, h. a mirror coupled with the female part of the buckle assembly, i. a slot opening in the female part of the buckle assembly, j. a striking device coupled with one of the parts of the buckle assembly, k. a locking pin coupled with the male part of the buckle assembly, l. a locking tab coupled with the male part of the buckle assembly, m. a whistle formed integrally with the male part of the buckle assembly, n. a blade configured with a sharp edge, a serrated edge, and a fishing hook like shape, and the blade has an orifice on its back end, o. the shield is configured to give shape to the bracelet, and is configured to protect and to store the blade, p. cotton lint and petroleum jelly to protect the blade from outside hazardous elements.

7. The components of claim 6, wherein the compass, the LED light, the locking pin, locking tab, the striker device, whistle, slot, opening, and mirror are coupled with the buckle assembly; wherein a "D" ring is connected with the shield, and the blade, the cotton lint, the petroleum jelly are inside the shield, and wherein the cord is wrapped around the shield to become an exterior of the bracelet.

8. The components of claim 7, wherein some components of the bracelet assembly can be configured into a knife assembly, comprising the buckle assembly and the blade, the blade can be inserted into the buckle assembly thereby forming the knife assembly.

9. The components of claim 7, wherein some components of the bracelet assembly can be configured into a fire-start kit, comprising the striking device which gives off sparks, the blade used to contact the striking device, the cord wrapped around the blade to provide a grip, the cotton lint provides an ignite-primer, and the petroleum jelly that works as a fuel.

10. The components of claim 7, wherein some of the components of the bracelet assembly can be formed into a fishing kit, comprising the cord to form a fishing line, and the blade that can be used as a fishing hook, wherein tying up the blade by the orifice with the cord forms the fishing kit.

* * * * *